United States Patent [19]

Barisoni et al.

[11] 4,014,717

[45] Mar. 29, 1977

[54] METHOD FOR THE PRODUCTION OF HIGH-PERMEABILITY MAGNETIC STEEL

[75] Inventors: Mario Barisoni, Albano Laziale; Massimo Barteri, Rome; Roberto Ricci Bitti, Lanuvio; Pietro Brozzo, Albano Laziale; Edmondo Marianeschi, Terni, all of Italy

[73] Assignees: Centro Sperimentale, Metallurgico S.p.A.; Terni Societa per l'Industria e l'Elettricita S.p.A., both of Rome, Italy

[22] Filed: Sept. 16, 1975

[21] Appl. No.: 613,956

[30] Foreign Application Priority Data

Oct. 9, 1974 Italy ..... 53432/74

[52] U.S. Cl. ..... 148/111; 148/31.55; 148/112

[51] Int. Cl.[2] ..... H01F 1/04

[58] Field of Search ..... 148/112, 111, 31.55; 75/123 L

[56] References Cited

UNITED STATES PATENTS

| | | | |
|---|---|---|---|
| 3,636,579 | 1/1972 | Sakakura et al. | 148/111 |
| 3,846,187 | 11/1974 | Sakakura et al. | 148/112 |
| 3,872,704 | 3/1975 | Ohya et al. | 148/111 |
| 3,876,476 | 4/1975 | Matsuoka et al. | 148/111 |

*Primary Examiner*—Walter R. Satterfield
*Attorney, Agent, or Firm*—Cushman, Darby & Cushman

[57] ABSTRACT

A process for the production of oriented-grain high magnetic permeability steel sheet including the steps of continuously casting a steel slab haing a weight % composition within the range of 2.5–3.5 Si, 0.01–0.04 S, less than 0.07 C, less than 0.15 Mn, and an acid-soluble aluminum in an amount between 0.01 and 0.05, at a feed rate ranging from 700 to 1000 kg/minute, into an ingot mold of a length over 1200 mm and cooling it in said ingot mold with a quantity of water ranging from 2.8 to 4 $m^3$ per ton of steel; heating the slab so obtained to 1300°–1400° C and immediately thereafter hot-rolling it to a thickness in the range between 2 and 3.1 mm, annealing the strip so obtained at a temperature in the range between 1050° and 1150° C, keeping it at this temperature for a duration between 5 and 30 seconds; cooling it at any desired cooling rate to 750°–850° C at a temperature at which austenite is still present in it; keeping the strip at this temperature for a duration ranging from 30 to 200 seconds; and finally quenching it from the initial quenching temperature of 400° C at a cooling rate of between 10° C/second and 100° C/second; cold-rolling the strip so obtained with a reduction rate ranging from 80 to 90% and subjecting it finally to the decarburization and recrystallization annealing operations as well as to other final anneals.

3 Claims, No Drawings

METHOD FOR THE PRODUCTION OF HIGH-PERMEABILITY MAGNETIC STEEL

The invention refers to a procedure for the production of high permeability magnetic steel sheet, and more specifically it relates to a procedure according to which, starting from a continuously cast slab directly transformed, without any intermediate prerolling stage, into a hot-rolled strip, a high-permeability oriented-grain steel sheet is produced, whose permeability and losses have a high degree of uniformity throughout the length of said strip.

Many procedures for the production of an oriented-grain high-permeability steel sheet are known. For instance, in the U.S. Pat. No. 3,636,579 granted to Nippon Steel Co. and claiming the priority of Apr. 24, 1968, a procedure is described, wherein a steel containing from 0 to 4% Si, less than 0.085% C and from 0.010 to 0.065% acid-soluble Al is hot rolled, annealed at a temperature ranging between 750° and 1200° C for Si from 0 to 1% and C up to 0.080%, at a temperature between 850° and 1200° C for Si from 1 to 2.5% and C from 0.010 to 0.080%, and at a temperature between 950° and 1200° C for Si from 2.5 to 4$ and C from 0.20 to 0.080%; the time of stay of the strip at the preselected annealing temperature ranges from 30 seconds to 30 minutes. The so annealed strip is thereafter quenched from the annealing temperature to a temperature lower than or equal to 400° C in a time ranging from 2 and 200 seconds, and finally cold rolled with a reduction rate of 65–95%.

In the Belgian Pat. No. 797,781 granted to Nippon Steel Co., claiming the priority of Apr. 5, 1972, there is described another procedure for the production of oriented grain magnetic steel sheet starting from continuously cast slabs, consisting in continuously casting a steel containing not over 0.085% C, from 2 to 4% Si and from 0.010 to 0.065% acid-soluble Al, subjecting said slabs to a first hot-rolling or pre-rolling step, at a temperature under 1300° C, with a reduction rate ranging between 30 and 70%, and thereafter to a second hot rolling step up to the final thickness of the hot rolled strip. The so obtained strip is annealed at a temperature between 950° and 1200° C, quenched and thereafter cold-rolled with a reduction rate between 81 and 95%; in this procedure, over 80% of the grains of the slab have a mean diameter of less than 25 mm after preheating for the second hot-rolling step.

The U.S. Pat. No. 3,764,406 granted to Armco Steel Co., claiming the priority of Nov. 4, 1971, describes a procedure, wherein the continuously cast slab containing from 2 to 4% Si and having a thickness of 10–30 cm, is heated to 750°–1250° C, hot-rolled with a reduction ate between 5 and 50%, again heated to 1260°–1400° C in order to obtain grains having a mean diameter of not over 4.5 ASTM at 1 x; the slab so treated is hot-rolled to the desired thickness and thereafter cold-rolled with a strong reduction rate and finally subjected to the usual final annealing treatments.

The last two specifications quoted clearly state the necessity of performing a first pre-rolling step at a temperature below 1300° C, followed by a heat at a temperature over 1300° C and a hot-rolling step to the desired strip thickness, which ranges generally between 2 and 5 mm. This necessity stems from the fact that the continuously cast slabs have a columnar structure which, during the anneal at a temperature over 1300° C would lead to an excessive grain growth, which would prevent the obtention of high magnetic properties; therefore this columnar structure must be destroyed by a first preliminary hot rolling step with a moderate reduction rate.

Furthermore, in the literature concerning the field of the manufacture of oriented-grain high permeability magnetic steel sheet, stress is laid upon the necessity of using inhibitors for the growth of the primary grain, in particular aluminum nitride; this inhibitor supposedly acts at the moment of the secondary recrystallization and should be precedently precipitated in a suitable amount, shape, size and distribution. Up to now, the obtention of high magnetic properties has been solely attributed to the action of these inhibitors.

In the state of the art, through the U.S. Pat. No. 2,528,216, the property of aluminum nitride of inhibiting grain growth was known as from 1948 and already in former times the U.S. Pat. No. 2,113,537 had disclosed a procedure for the production of magnetic steel sheet, wherein a steel containing 3.5% Si and 0.1% Al was hot rolled, annealed at 1000° C, quenched and successively cold-rolled. However, only recently, by the above quoted U.S. Pat. No. 3,636,579 there has been developed a procedure, which, although starting from known bases, takes into account some precipitation conditions of the aluminum nitride, which, according to said U.S. patent, should render it possible to obtain particularly high magnetic properties.

In other terms, one may say that up to the present time, in the state of the art, it was held that only by means of a growth inhibitor of the primary grains, such as the AlN, precipitated in given amounts, sizes and distribution, it was possible to obtain particularly high magnetic properties, and that such properties were to be ascribed merely to the action of this inhibitor in the secondary recrystallization phase.

During the studies which have led to the present invention and which have been carried out by the inventors on a semi-industrial scale and upon some hundred tons of steel, it has been discovered that it is possible to act upon the steel prior to the secondary recrystallization phase, even as early as from the solidification of the continuously cast slabs and prior to the primary recrystallization, in order to promote the obtention of a primary recrystallization grain having optimum sizes and orientation, as it will be better explained in the following.

According to the present invention, it has been found that a steel sheet having magnetic properties superior to those hitherto known in the art can be produced if, in addition to a grain growth inhibitor such as a finely precipitated aluminum nitride in the desired volumetric ratio, prior to each cold rolling stage a high hardness microstructural component is formed in the steel by quenching, which permits to obtain rolling and primary recrystallization textures which are optimal for the orientation of the secondary recrystallization grains.

The invention permits additionally to directly hot-roll to the desired final thickness a continuously cast slab, thereby eliminating the initial pre-rolling stage.

The object of the present invention is therefore that of providing a procedure for the production of an oriented-grain high magnetic permeability steel sheet, which permits to avoid the initial pre-rolling stage of the slab prior to its hot-rolling, although supplying a product with high magnetic properties, which are particularly uniform from one end to the other of the strip.

It is known that during secondary recrystallization one part of the grains having the (110) (001) orientation grow at the expense of the adjacent, differently oriented crystals, that the texture of the primary recrystallization conditions the quality of the final product and that the texture of the primary recrystallization and the completeness of the secondary recrystallization are influenced by the original solidification structure of the slab or of the primary ingot.

It appears that hitherto these known facts have not been correlated to deduce a procedure which, starting from the control of the solidification structure of the steel, would permit to act upon the primary recrystallization texture and upon the completeness of the secondary recrystallization. In fact, up to the present time, the procedures disclosed in the initially quoted state of the art were limited to mechanically modifying the solidification structure of the continuously cast steel and to act upon it during the secondary recrystallization stage. However, it is evident that if one succeeds in obtaining a suitable solidification structure of the continuously cast steel and in adjusting the primary recrystallization texture, one may obtain with greater facility and in a more inexpensive manner magnetic steel sheet with better and more constant characteristics.

A further object of the procedure of the present invention is that of permitting to adjust the primary recrystallization texture.

According to the present invention, a steel containing from 2.5 to 3.5% Si, less than 0.07% C and preferably acid-soluble Al in amounts ranging from 0.01 to 0.05%, is continuously cast at the lowest possible cooling rate in a mold and outside a mold, so as to initially obtain a solidification structure which is less columnar than that which is obtainable with the usual continuous casting techniques, and with a different distribution of the precipitates, so as to prevent, in a first stage, an excessive grain growth during the reheat treatment of the slab at 1300°–1400° C prior to hot-rolling, and successively, after its cold-rolling, to permit the formation of a primary recrystallization texture favorable to the obtention of the finished product having the desired high magnetic properties.

The procedure according to the present invention additionally comprises, after the hot-rolling in a single stage, an anneal at 1050°–1150° C, cooling to a temperature at which austenite is still present in the steel, keeping the steel at this temperature for a duration variable from 30 to 200 seconds, and thereafter quenching. Owing to the sudden quenching from a temperature at which austenite is still present, a high hardness microstructural component is formed in the steel, which causes in the steel sheet, after its cold-rolling and primary recrystallization, the formation of a number of crystals having their plane 110 parallel to the steel sheet surface, this number being higher than that which may be obtained without the high hardness microstructural component; during the secondary recrystallization a fraction of these crystals grows in size, which leads to a product having better magnetic properties. The better and more uniform primary texture produced, during cold-rolling, thanks to the presence of the high hardness microstructural component obtained by quenching also permits the obtention of considerably uniform magnetic properties from one end to the other of the strip.

The importance of said high hardness microstructural component has so far never been taken into consideration. On the contrary, the state of the art was teaching exactly the opposite of what we have found; in fact, in column 2, lines 42–44 of the U.S. Pat. No. 3,636,579 we have repeatedly quoted, there is stated that quenching must be performed from a temperature range wherein the conversion from $\gamma$ to $\alpha$ has been completed, and in another passage it is recommended tp quench from a temperature at which at least a part of $\gamma$ has been converted into $\alpha$, in order to obtain high magnetic properties. It is clear that thereby this specification intends to teach that the presence of high hardness microstructural components induced by quenching is detrimental and that these hard microstructural components must at least be contained within minimum proportions.

According to the invention it has instead been found that a high hardness microstructural component produced by quenching is not only not detrimental, but even that this component must be present in the steel before it is cold rolled down to a heavy thickness reduction.

For a purely exemplificative and in no way limitative purpose, one manner of carrying it into practice will be described in greater detail in the following:

A liquid steel having a weight percent composition in the range of 2.5–3.5% Si; 0.01–0.04% S; under 0.07% C; under 0.15% Mn; and preferably Al in an acid-soluble form in an amount ranging from 0.01 and 0.05%, is continuously cast at a temperature between 1500° and 1600° C, into an ingot mold of a length not less than 1200 mm, at a feed rate between 700 and 1000 kg/minute, while cooling is kept at a level such that the slope of the cooling curve attains the minimum possible value, the quantity of the cooling water circulating in the mold ranging between 2.8 and 4 $m^3$ per ton of steel, preferably below 3.7 $m^3$ per ton of steel.

The slabs so produced are directly conveyed to a heat treatment at 1300°–1400° C, and immediately thereafter hot-rolled to a thickness ranging between 2 and 5 mm, preferably between 2 and 3.1 mm.

After hot rolling, the strip is annealed at a temperature ranging between 1050° and 1150° C, and kept at this temperature between 5 and 30 seconds and preferably between 15 and 30 seconds. The strip is thereafter cooled at any desired rate to 750°–850° C, and anyhow to a temperature at which austenite is still present, kept at this temperature for a duration between 30 and 200 seconds, and finally quenched at a mean cooling rate from the starting temperature down to 400° C, said cooling rate ranging between 10° C/second and 100° C/second, said rate presenting an optimum value as a function of the C and Si content of the steel. This treatment permits to obtain the optimum amount of austenite, and thus the optimum amount of high hardness microstructural component, which must be present in a volume ratio between 1 and 20%, preferably between 1 and 8%. After this quenching treatment, the strip is cold rolled, preferably in two stages, the first of which with a 20–50% thickness reduction followed by an additional reheat treatment at 750°–900° C and another quench, at a cooling rate between 10° C/second and 100° C.second. There follows the second cold rolling stage with a 80–90% thickness reduction rate and the usual series of final anneals.

Alternately, cold rolling may also be carried out in a single stage, with a thickness reduction rate of 80–90%, in which case the second quench treatment is omitted after the cold rolling.

The high-hardness microstructural component obtained by quenching, in addition to improving the primary recrystallization texture, has also the property of reducing, during the second recrystallization, the ratio between the sum of the number of crystals having the planes 111 and 332 parallel to the surface of the steel sheet, and the number of the crystals having their plane 110 parallel to the surface of the steel sheet; this is also a factor which contributes to the improvement of the final magnetic properties of the steel sheet.

According to the present invention it is necessary that this ratio [(111) + (332)]/(110) be also less than 35 after cold-rolling and primary recrystallization.

The procedure of the present invention is based therefore on concepts which are different from those which are tought by the state of the art inasmuch as the invention starts from the idea of obtaining within the steel, and already in the continuously cast slab, a structure such as to condition, through the formation of a high hardness microstructural component obtained by quenching, the primary recrystallization texture, thereby permitting to obtain a better orientation of the secondary recrystallization grains.

A preferred procedure for carrying the invention into practice is the following.

A steel having the following weight percent composition: 0.040 C; 2.76 Si; 0.034 acid-soluble Al; 0.008 N, 0.10 Mn; 0.03 S, the balance being essentially iron and minor impurities, has been cast at a ladle temperature of 1580° C into an ingot mold 1500 mm long and having a useful cross-section of 900×140 mm, at a feed rate of 770 kg/minute. The flow rate of the cooling water in the mold was 3.4 $m^3$/ton of steel, while in the first cooling region outside the mold the flow rate of the water was 0.23 $m^3$ and in the successive ones 0.08 $m^3$ per ton of steel.

The slabs so obtained have been directly hot-rolled to a thickness of 2.1 mm, after a previous heating to 1390° C in a pusher type furnace. The strip so obtained has been heated to 1130° C, kept at this temperature for 25 seconds, thereafter cooled to 840° C, kept at this temperature for 80 seconds and quenched in water. After quenching the strip has been cold rolled with a reduction rate of 30%, annealed to 900° C for 25 seconds, again quenched in water and cold-rolled with a reduction rate of 85%. The strip so obtained has finally been subjected to the usual treatment of recrystallization, decarburization etc. The results obtained are recorded in columns A and B of table I.

For the purposes of comparison, other steel slabs of the same composition and conventionally obtained by continuous casting have been rolled to a 50% thickness reduction at 1260° C, heated to 1380° C and hot-rolled to a thickness of 2.1 mm. The strip so obtained has been treated according to the teaching of the U.S. Pat. No. 3,636,579, however, since because of the composition of the steel it had not been possible to complete the conversion from $\gamma$ to $\alpha$ at the recommended quenching temperature, the hard microstructural component obtained by quenching has been destroyed by heating to 500° C, which has in no way altered the texture of the sheet, nor the sizes, the amount and the distribution of the aluminum nitride precipitate, as shown by the electronic microscope, X-ray and other crystallographic inspections.

Another slab of the same composition has been subjected to a first treatment according to the Belgian Patent specification 797,781 and after hot-rolling it has been treated according to the present invention. A last slab of the same composition has been treated according to the present invention, but excluding the quench treatment. At the end of the process, steel sheet coils, each weighing approximately 3 tons were obtained. From each of these coils a series of samples were taken, which have been inspected. It has already been stated that according to the present invention,, in order to obtain good magnetic properties, the steel sheet, after primary recrystallization, must have a ratio of [(111) + (332)]/(110) lower than 35. It has also been stated that, by proceeding according to the present invention, it is possible to obtain, already from the primary recrystallization stage, a structure which is suitable to the attainment of the best magnetic properties.

It is therefore evident that if in the crystallographic inspection we shall find a sample wherein the number of the crystals with their plane 110 parallel to the sample surface is greater than in the other samples, and simultaneously wherein a ratio [(111) + (332)]/(110) is lower than in the other samples, especially if lower than 35, this sample is bound to have the best magnetic properties.

In table I there are recorded the intensities relating to some important crystallographic planes parallel to the steel sheet surface, the values of the ratios [(111) + (332)]/(110), of the magnetic permeability $B_{10}$, of the losses at 1.7 weber in w/kg, of the volume percentages of the high hardness microstructual components obtained by quenching, for a series of groups of 30 samples, the mean value being recorded for each group of samples. The groups are marked thus:

Group A: steel according to the present invention, as precedently exemplified, immediately after cold-rolling to a heavy thickness reduction.

Group B: the same steel as group A, after primary recrystallization.

Group C: steel from a different slab, but having the same composition than the preceding groups, subjected to a 50% reduction pre-rolling, heating to 1360° C and hot-rolling to 2.1 mm and thereafter treated according to the present invention; inspected after primary recrystallization.

Group D: steel according to the U.S. Pat. No. 3,636,579, quenched and annealed at 500° C to eliminate the high hardness microstructural component after primary recrystallization.

Group F: same steel from the same cast, unquenched steel, after primary recrystallization.

The data of the magnetic properties are mean data measured directly on line after the final decarburization and secondary recrystallization treatments.

Table I

| crystallographic plane | group A | group B | group C | group D | group E |
|---|---|---|---|---|---|
| 110 | 0.16 | 0.22 | 0.17 | 0.10 | 0.08 |
| 100 | 1.43 | 1.36 | 1.20 | 1.13 | 0.60 |
| 211 | 1.00 | 0.90 | 0.80 | 0.79 | 0.67 |
| 310 | 1.10 | 0.70 | 0.80 | 0.59 | 0.38 |
| 111 | 2.20 | 2.10 | 3.00 | 3.14 | 4.47 |
| 321 | 0.36 | 0.52 | 0.42 | 0.35 | 0.20 |
| 332 | 0.75 | 1.20 | 0.60 | 0.90 | 0.60 |
| $\frac{(111)+(332)}{(110)}$ | 18 | 15 | 21 | 40 | 64 |
| $B_{10}$ | — | 19300 | 19200 | 18200 | 17600 |
| % dispersion of $B_{10}$ S = 0.35 mm | — | 1 | 1 | 4 | 5 |
| losses at 1.7 weber, w/kg | — | 1.25 | 1.30 | 1.40 | 1.50 |
| volume % of the | | | | | |

Table I-continued

| crystallographic plane | group A | group B | group C | group D | group E |
|---|---|---|---|---|---|
| high hardness microstructural component obtained by quenching | 6 | 6 | 6 | 0 | 0 |

We claim:

1. A method for the production of oriented-grain high magnetic permeability steel sheet, comprising the steps of continuously casting a steel slab having a weight % composition within the range of 2.5–3.5 Si, 0.01–0.04 S, less than 0.07 C, less than 0.15 Mn, and an acid-soluble aluminum in an amount between 0.01 and 0.05, at a feed rate ranging from 700 to 1000 kg/minute, into an ingot mold of a length over 1200 mm and cooling it in said ingot mold with a quantity of water ranging from 2.8 to 4 $m^3$ per ton of steel, wherein said cooling is undertaken at a rate such that the slope of the cooling curve attains the minimum possible value; heating the slab so obtained to 1300°–1400° C and immediately thereafter hot-rolling it to a thickness in the range between 2 and 3.1 mm, annealing the strip so obtained at a temperature in the range between 1050° and 1150° C, keeping it at said temperature for a duration between 5 and 30 seconds; cooling it to 750°–850° C at a temperature at which austenite is still present in it, and keeping the strip at this temperature for a deviation ranging from 30 to 200 seconds; and finally quenching it from the initial quenching at a mean cooling rate from the starting to 400° C at a cooling rate ranging between 10° C/second and 100° C/second thereby resulting in an optimum austenite content and thus an optimum amount of high hardness microstructural component which is, in a volume ratio from between 1 to 20%; cold-rolling the strip so obtained with a reduction ate ranging from 80 to 90% and subjecting it finally to decarburization and recrystallization annealing operations.

2. A method according to claim 1, wherein the quench rate is such that it causes in the steel the formation of a high hardness microstructural component ranging between 1 and 8 volume %.

3. The method of clam 1, wherein said component reduces the ratio of [(1119 + (132)]/(110 ), which is the ratio between the sum of a number of crystals having the planes 111 and 332 parallel to the surface of the steel sheet and the number of the crystals having their 110 plane parallel to the surface of the steel sheet, to less than 35.

* * * * *